US005127750A

United States Patent [19]

Burgin

[11] Patent Number: 5,127,750

[45] Date of Patent: Jul. 7, 1992

[54] REFILLABLE INK RIBBON CARTRIDGE

[75] Inventor: Markus Burgin, Uster, Switzerland

[73] Assignee: Franz Buttner AG, Egg, Switzerland

[21] Appl. No.: 491,476

[22] Filed: Mar. 8, 1990

[30] Foreign Application Priority Data

Mar. 8, 1989 [CH] Switzerland ..... 863/89
Jul. 18, 1989 [DE] Fed. Rep. of Germany ..... 8908696

[51] Int. Cl.[5] ..... B41J 35/28

[52] U.S. Cl. ..... 400/208; 400/242; 400/247

[58] Field of Search ..... 400/207, 208, 208.1, 400/223, 242, 243

[56] References Cited

U.S. PATENT DOCUMENTS

| | | | |
|---|---|---|---|
| 3,976,183 | 8/1976 | Fleischmann et al. | 197/151 |
| 4,134,693 | 1/1979 | Crickmore et al. | 400/208 |
| 4,212,551 | 7/1980 | Marsico | 400/242 |
| 4,240,757 | 12/1980 | Hanna | 400/196.1 |
| 4,367,963 | 1/1983 | Daughters | 400/207 |
| 4,486,107 | 12/1984 | Wilcox | 400/208 |
| 4,854,755 | 8/1989 | Lange et al. | 400/208 |
| 4,859,097 | 8/1989 | Frerichs | 400/208 |
| 4,861,177 | 8/1989 | Heins et al. | 400/208 |
| 4,867,586 | 9/1989 | Shimoyama | 400/208 |
| 4,913,572 | 4/1990 | Behrens et al. | 400/207 |
| 4,955,737 | 9/1990 | Haftmann et al. | 400/208 |
| 4,964,743 | 10/1990 | Haftmann et al. | 400/207 |
| 4,990,006 | 2/1991 | Haftmann et al. | 400/208 |
| 5,034,755 | 7/1991 | Kayata | 400/208 |

FOREIGN PATENT DOCUMENTS

| | | | |
|---|---|---|---|
| 8633789 | 5/1987 | Fed. Rep. of Germany . | |
| 3705058 | 1/1988 | Fed. Rep. of Germany . | |
| 3722224 | 12/1989 | Fed. Rep. of Germany . | |
| 8123227 | 6/1982 | France | 400/208 |
| 2575416 | 12/1985 | France . | |
| 61-19383 | 1/1986 | Japan . | |

*Primary Examiner*—Edgar S. Burr
*Assistant Examiner*—John S. Hilten
*Attorney, Agent, or Firm*—Blum Kaplan

[57] ABSTRACT

A refillable ink ribbon cartridge including an adapter element which can be permanently inserted in a typewriter and receive a replaceable ink ribbon. The adapter includes a ribbon drive mechanism for advancing the ink ribbon cassette. The adapter includes a body portion and two extending legs and centering pins at the free ends and a ribbon tensioning lever. The cassette is formed with a body portion and two protruding legs with guiding elements to guide the ribbon across the free end of the legs. A drive wheel is rotatably mounted on a spring loaded arm to pull the ribbon through the cartridge, the arm is rotatable about a drive pin. Upon insertion of the refill cassette into the adapter, the two systems align and interact so that the ribbon is guided by the associated protruding legs and guiding elements to run smoothly through the cartridge. When the ribbon supply has been depleted, the adapter remains in the typewriter, but the depleted refill unit is removed and a new cassette is replaced into the housing quickly and easily.

16 Claims, 6 Drawing Sheets

FIG. 6
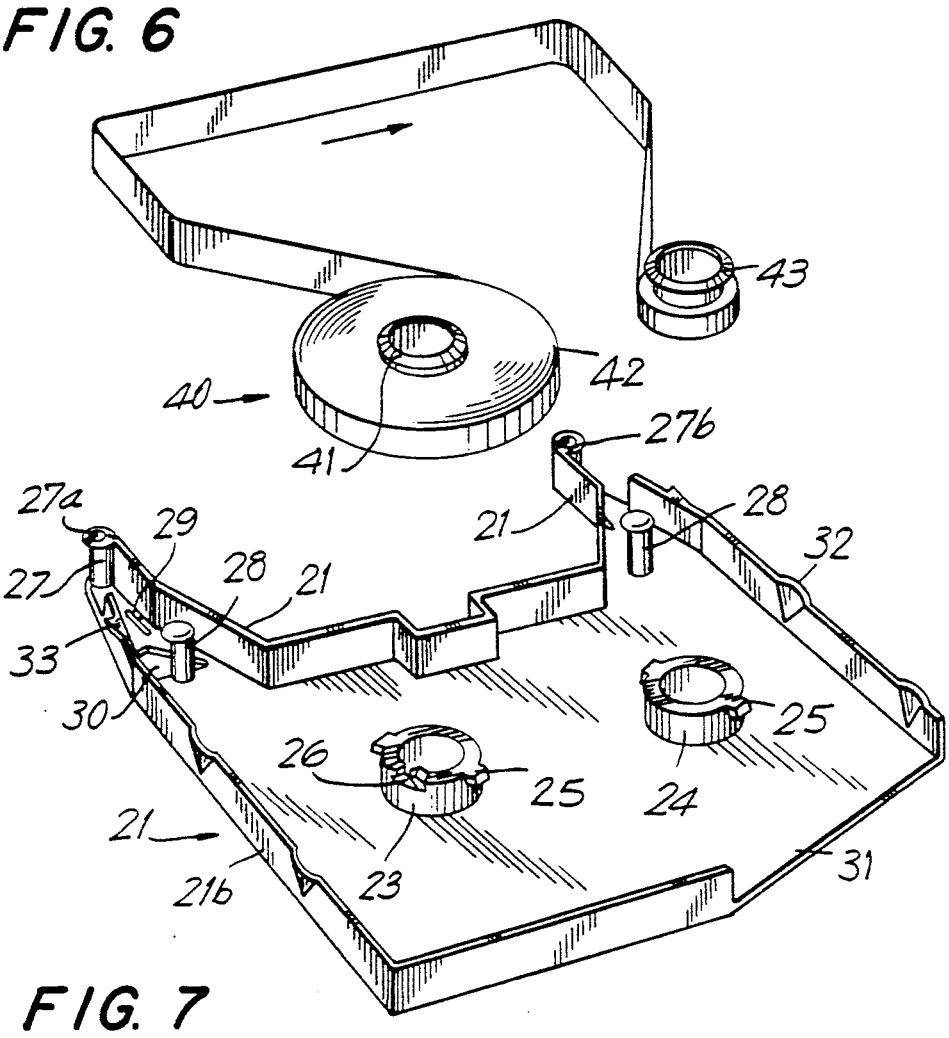
FIG. 7
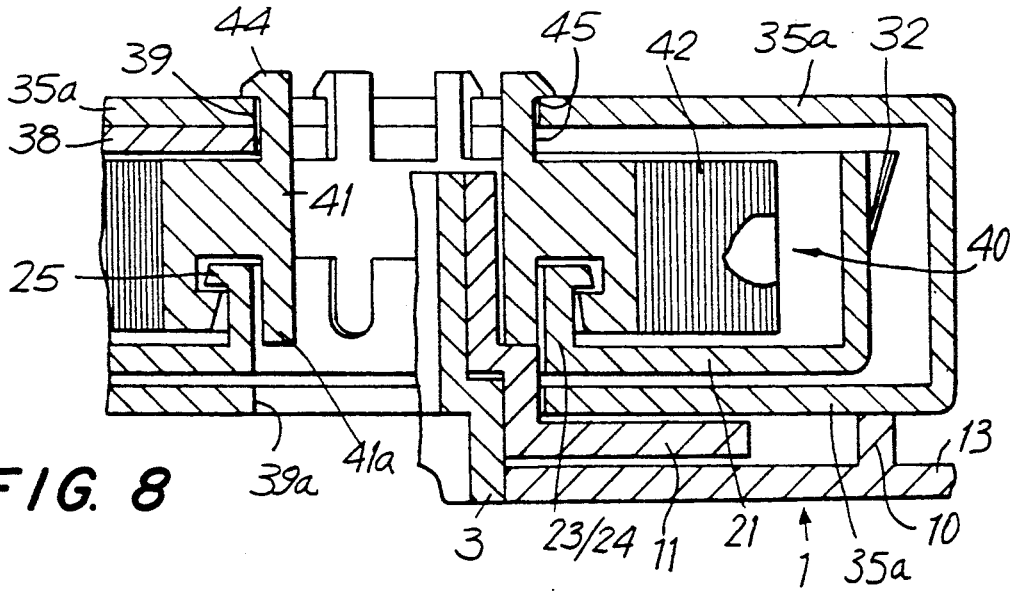
FIG. 8

FIG. 12
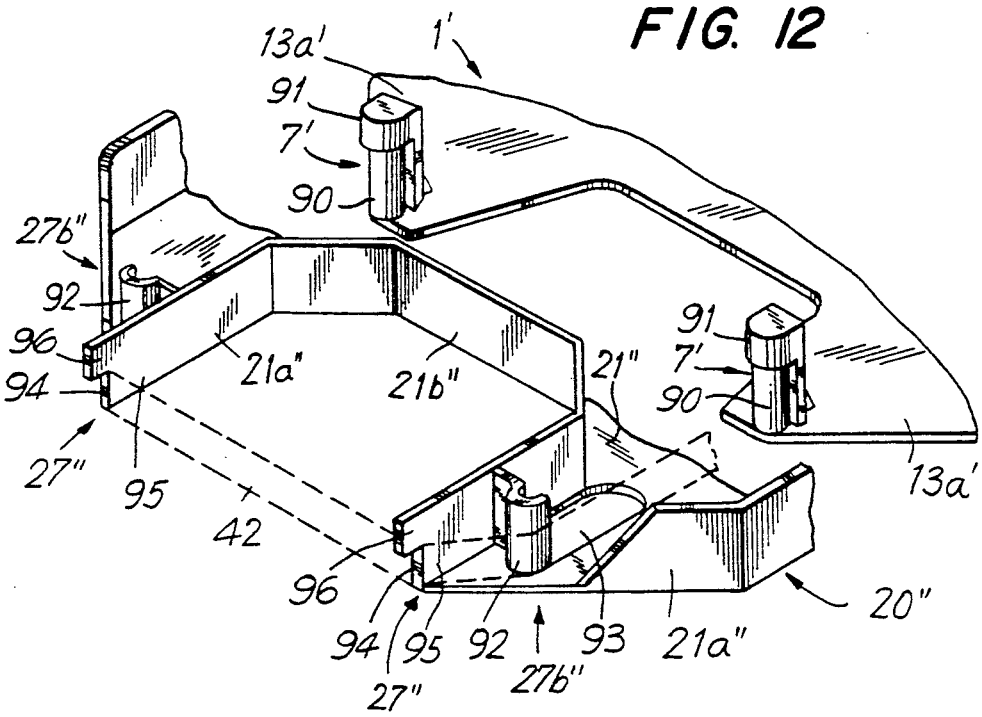
FIG. 13
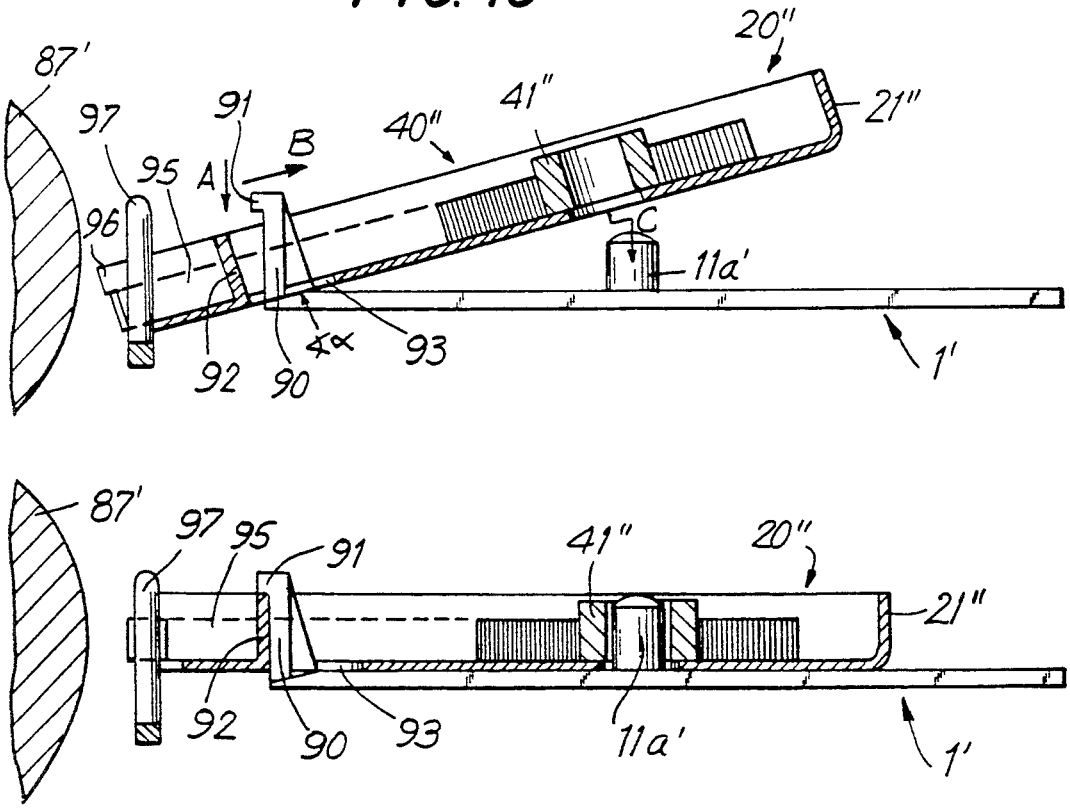
FIG. 14

REFILLABLE INK RIBBON CARTRIDGE

BACKGROUND OF THE INVENTION

This invention relates in general to a refillable ink ribbon cartridge, and in particular to a ribbon cartridge including a replaceable ink ribbon supply unit which fits an adapter having a ribbon driving mechanism for easy replacement after depletion of the ribbon.

Refillable ink ribbon cartridges are known in the art as shown in German Patent DE-OS No. 3 524 730. This refillable ink ribbon cartridge includes a housing which contains a feed reel with a feed core. The feed core is fixed with respect to rotation on a brake disk rotatably mounted in a casing. A ribbon tensioning device interacts with the brake disk. The ink ribbon is pulled from the feed reel via the ribbon tensioning device and ribbon guiding elements on the free ends of two protruding legs of the housing to a take-up core. The take-up core is rotatably mounted on a spring loaded swivel arm. The swivel arm presses the take-up core against a sprocket wheel which is fixedly mounted to the housing and includes a driving pin to engage the driving element of a typewriter or printer.

A new ribbon is inserted by first removing the cartridge from the typewriter. The swivel arm with the take-up reel is swung away from the sprocket by means of a lever. At this point, the take-up reel containing the used ribbon and the feed core are removed from the typewriter. The new feed reel is placed on the brake disk and a new take-up core is placed on the swivel arm. The free end of the ribbon is then pulled through the ribbon guiding elements to the take-up core. A pin with a preset breaking point is fastened at the beginning of the ribbon. The lower section of the pin is finally placed into a slot of the take-up core and the remainder of the pin is broken off. After the cover has been closed, the reloaded cartridge is inserted into the typewriter.

This reloading procedure is both complicated and time consuming, because the entire cartridge must be removed from the typewriter for reloading. Furthermore, when the lever is locked, the take-up core swings against the sprocket wheel whereby the ribbon becomes loose. This causes the first windings on the take-up reel to be wound poorly which can cause difficulties with further winding.

Accordingly, it is desirable to provide a reloadable ink cartridge which overcomes the shortcomings of prior art device as described above and allows the easy reloading and refilling of the ribbon into a refillable ink ribbon cartridge.

SUMMARY OF THE INVENTION

Generally speaking, in accordance with the invention, a refillable ink ribbon cartridge including an adapter with driving mechanism and a replaceable ink ribbon supply unit is provided. The adapter housing has an open top and is formed with two protruding support legs with centering elements and a ribbon tensioning element. An ink ribbon supply cassette having two protruding legs including an ink ribbon wound on a feed reel through the legs to a wind-up spool. The cassette is removable from and insertable into the adapter for operatively engaging a drive wheel rotatably mounted on a spring loaded arm in the housing. The drive wheel is operatively a to drive pin of the printing device and is urged against the ribbon on the take-up core for pulling the ribbon from the ribbon supply over the ribbon guiding and tensioning elements. The ink supply cassette can be inserted into the cartridge without removing the adapter from the printing device.

Accordingly, it is an object of the invention to provide an improved refillable ink ribbon cartridge.

Another object of the invention is to provide an improved ink ribbon cartridge which includes a housing adapter and a replaceable ink ribbon cassette.

A further object of the invention is to provide an improved ink ribbon cartridge which can be refilled easily without removal of the cartridge housing from the printing device.

Yet a further object of the invention is to provide a an improved ink ribbon cartridge which is both economically and ecologically sound.

Still other objects and advantages of the invention will in part be obvious and will in part be apparent from the specification and drawings.

The invention accordingly comprises the feature of construction, combination of elements and an arrangement of parts which will be exemplified in the construction hereinafter set forth, and the scope of the invention will be indicated in the claims.

BRIEF DESCRIPTION OF THE DRAWING

For a further understanding of the invention, reference is had to the following description taken in connection with the accompanying drawings, in which:

FIG. 6 is a perspective view of an ink ribbon for use in the ink ribbon cassette of FIGS. 4 and 5;

FIG. 7 is a perspective view of the cassette support of the cassette of FIGS. 4 and 5;

FIG. 8 is a cross-sectional view of the ink ribbon supply spool along line VIII—VIII of FIG. 1;

FIG. 12 is a partial perspective view of a refillable ink ribbon cassette as it is inserted into an adapter in accordance with another embodiment of the invention;

FIG. 13 is a sectional view of a refillable ink ribbon cartridge in accordance with the embodiment of FIG. 12 being inserted into a typewriter; and FIG. 14 is a sectional view of the cartridge of FIG. 13 after insertion.

DESCRIPTION OF THE PREFERRED EMBODIMENTS

Figure 1:
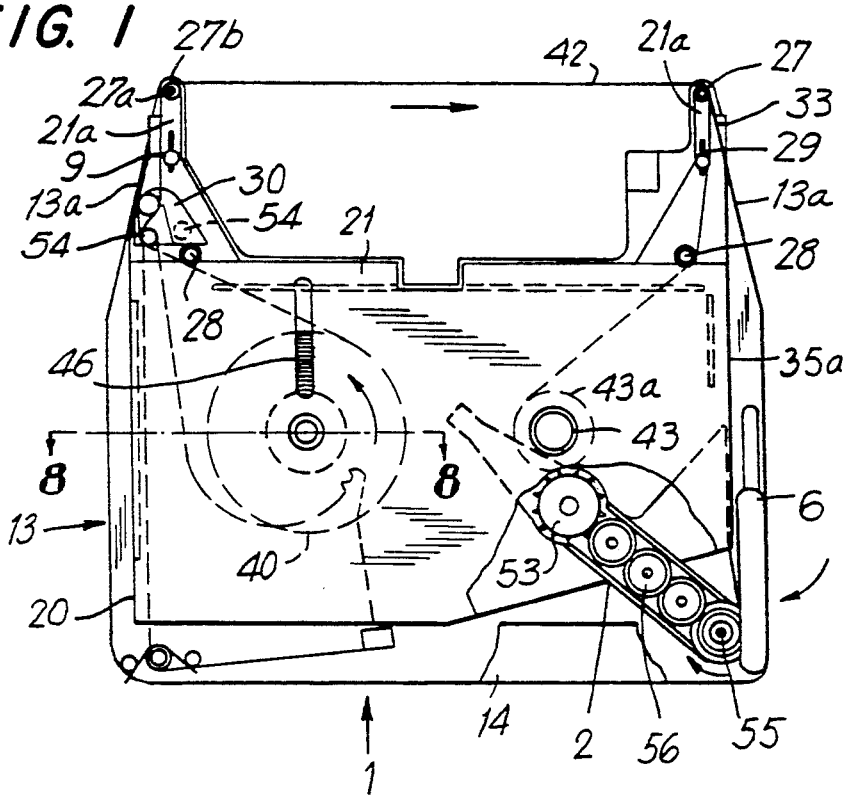
FIG. 1 is a top plan view of a refillable ink ribbon cartridge in accordance with the invention.

FIG. 1 is a plan view of a refillable ink ribbon cartridge for insertion into a typewriter constructed in accordance with the invention. Refillable ink ribbon cartridge 1 includes a housing adapter 13 and a replaceable ink ribbon supply cassette unit 20. Adapter 13 is designed so that it can remain permanently inserted in a typewriter or printer while cassette 20 is disposable and replaced after depletion of the ink ribbon. The mechanical parts needed to drive and tension a ribbon are housed in adapter 13. At the same time, cassette unit 20 contains a minimum number of individual parts. The two part system provides both an economical and ecological solution, and may be manufactured economically. Cassette 20 can be fabricated from environmentally compatible, dispensable non-metallic materials which are not expensive to fabricate.

Figure 2:
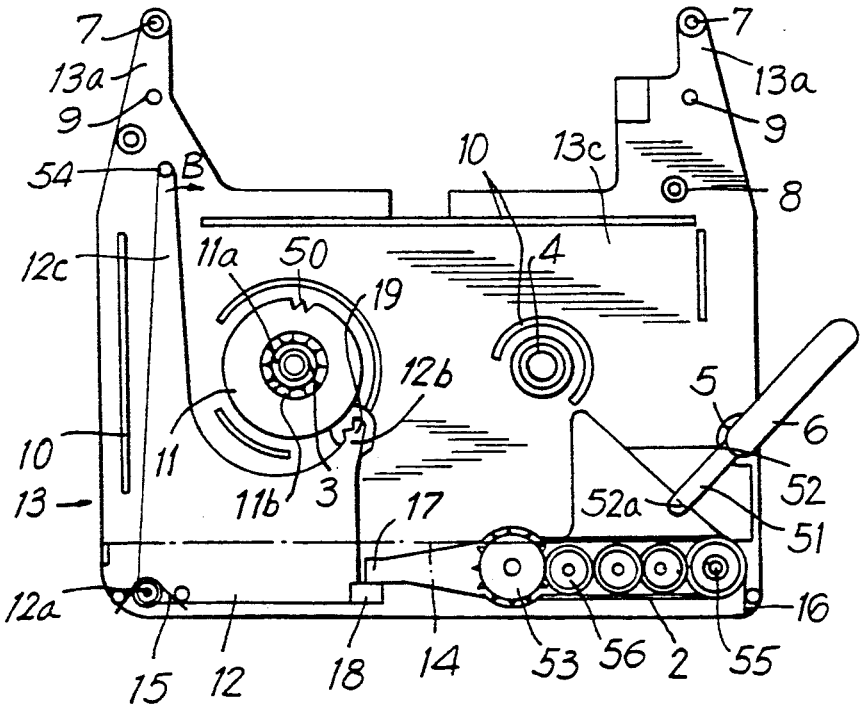
FIG. 2 is a top plan view of the housing adapter of the cartridge of FIG. 1.
Figure 3:
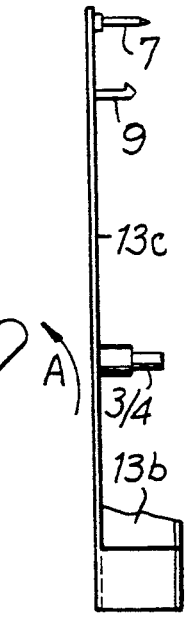
FIG. 3 is a side elevational view of the housing adapter of the cartridge of FIG. 2.

Referring specifically to FIGS. 2 and 3, adapter 13 includes an injection molded plastic housing 13 having an open top. Housing 13 has a flat base plate 13*c* and a side wall 13*b*. The rearmost region of housing 13 is covered with a narrow cover 14. Housing 13 has two protruding legs 13*a* with centering bodies 7 which extends from base plate 13*c*. A centering pin 8 is disposed at the region where right protruding leg 13*a* joins the main portion of base plate 3*c*. Several spacer webs 10 and two hollow pegs 3 and 4 are integrally formed on base plate 13*c*.

A brake disk 11 is integrally attached to a coaxial casing 11*a* and cannot be rotated with respect thereto and is securely attached to peg 3. Casing 11*a* is provided with a plurality of ribs 11*b* on its outer circumference. Brake disk 11 has teeth 50 about its outer circumference.

A ribbon tensioning element 12 in the form of a double-armed lever, is pivotably mounted on a pin 12*a* which is fixed in the bottom left hand corner of housing 13. A first arm 12*b* of tensioning element 12 includes a detent catch 19*a* at its free end. A projecting shoulder 18 is securely attached to the lower end of first arm 12*b*. A spring 15 at pin 12*a* biases detent catches 19*a* to engage teeth 50 of brake disk 11. A second arm 19*c* of tensioning element 12 supports a ribbon tensioning roll 54 at its free end in the region of the free end of left leg 13*a*.

A drive pin 55 at the right rear corner of housing 13 includes a cross-shaped penetration hole for engaging the drive shaft of a typewriter or printer is rotatably mounted in housing 13. A drive lever arm 2 is attached to pin 55. Arm 2 supports a sprocketed drive wheel 53 which is coupled to drive pin 55 by toothed intermediate wheels 56, rotation to rotation. The free end of arm 2 has a finger 17 which interacts with shoulder 18.

Arm 2 is pre-tensioned by a spring 16 to urge drive wheel 53 against a take-up reel 43*a* which is mounted on peg 4. Arm 2 has a control curve 52 to provide a path of movement for a double-bent activation lever 6. Lever 6 is snapped into a bearing 5 which is integrally attached to sidewall 13*b* within a cylindrical center section. When lever 6 is swung out in the direction of arrow A, a lever arm 51 of lever 6 rotates along control curve 52. This action forces arm 2 to swing against the force of spring 16 into a load position shown in FIG. 2. In this position lever arm 61 catches a detent notch 52*a* of control curve 52. In the load position, finger 17 swings tensioning element 12 clockwise over projection 18, so that tension roll 54 is swung away from its operating position in the direction of arrow B. At the same time, detent catches 19*a* disengage from teeth 50 of brake disk 11.

As shown in FIGS. 6 and 7, refill cassette includes an injected-molded plastic thin-wall support 21 formed with two protruding support legs 21*a* and a surrounding side wall 21*b*. Side wall 21*b* is interrupted at the free ends of legs 21*a* as well as on the right rear edge of support 21 to form a drive opening 31. Hollow pegs 27 serving as ribbon guiding elements are integrally attached at the free ends of legs 21*a*. Pegs 27 support a retainer collar 27*b* on the top as a guide for threading ribbon 42 through cassette 20. Two hollow pegs 23 and 24 are symmetrically disposed in the center of cassette 20 to act as further ribbon guiding elements 28. Hollow pegs 23 and 24 each have two detent projections 25, used as locking elements, at their free ends.

Ribbon supply 40 has ribbon 42 wound on a feed core 41 mounted on peg 23 and take-up core 43 mounted on peg 24. Projections 25 on pegs 23 and 24 secure cores 41 and 43 to the pegs. Ribbon 42 is guided through cassette 20 from feed reel 41 past ribbon guiding elements 27 and 28 and is fastened on take-up core 43. Tension roller 54, shown in FIGS. 1 and 2 mounted on adapter 1, extends through an opening 30 formed in the base of left support leg 21*a*.

Drive arm 2 extends into cassette 20 through an opening 31 at the right rear edge of support 21 to allow drive wheel 53 entry to ribbon 42. In each leg 21*a*, a longitudinal hole is cut out as a detent recess 29 to engage catches 9 of adapter 1 to hold it securely. Gripping tabs 33 are integrally attached to sidewall 21*b* to adjoin the free ends of legs 21*a*. This configuration enables cassette 20 to be conveniently removed from adapter 1.

Figure 4:
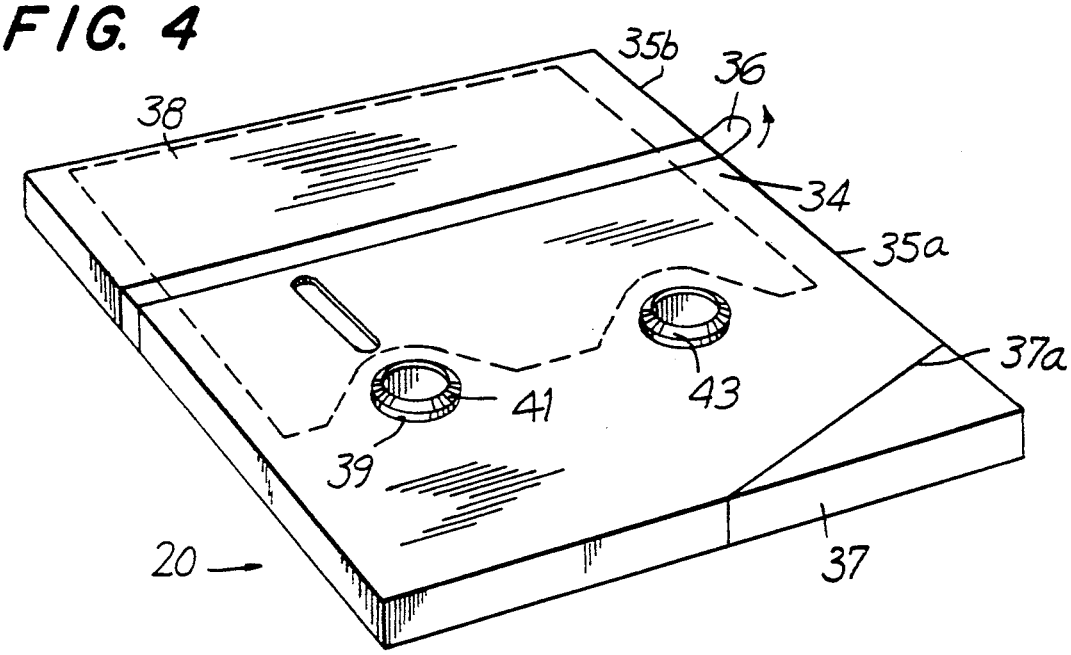
FIG. 4 is a top-rear perspective view of the ink ribbon supply cassette in its shipping condition.
Figure 5:
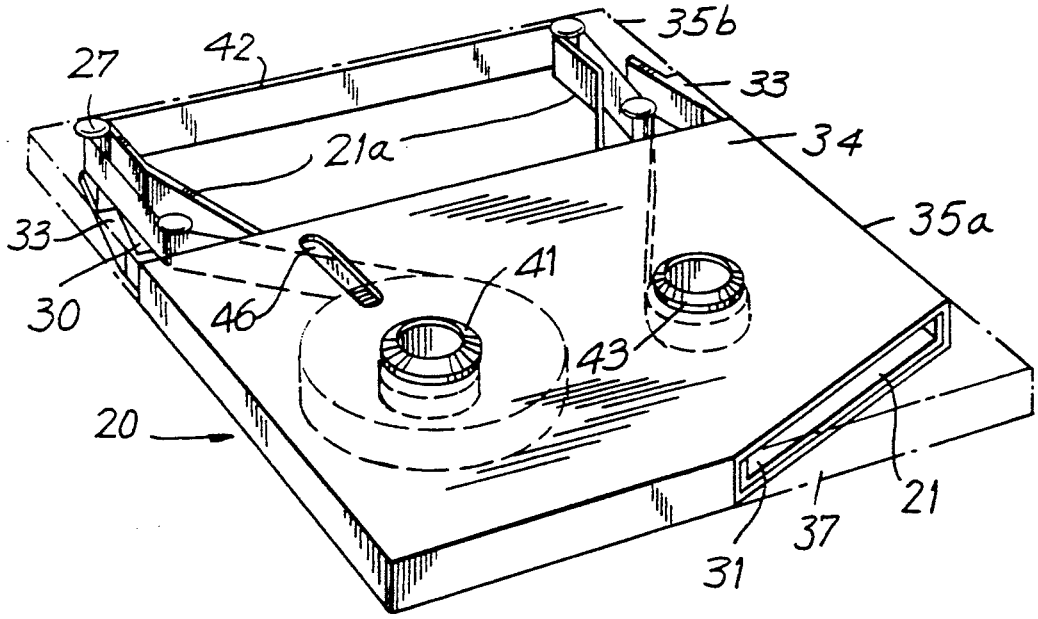
FIG. 5 is a perspective view of the ink ribbon supply cassette prior to insertion into the housing adapter.

Support 21 provided with feed reel 41 and take-up core 43 is placed in an enclosure 34 made in the form of a cardboard box as shown in FIGS. 4 and 5. Guide elements 32 located on sidewalls 21*b* of support 21 are used for centering support 21 in enclosure 34. Enclosure 34 is separated into a first rear part 35*a* and a second front part 35*b* by an all-around tear-out ribbon 36. First part 35*a* encloses the area of support 21 with feed reel 40 and take-up core 43. Enclosure 34 further includes two circular cut-out recesses 39 on the top surface for take-up core 43 and feed core 41 to extend therethrough. Both cores with detent catches 44 protrude behind recesses 39 as shown in FIG. 8.

The underside of first part 35*a* has round openings 39*a* aligned with recesses 39 for penetration of casing 11*a* and peg 4. On right bottom edge, a corner 37 of enclosure 34 can be separated by means of tearing a perforation 37*a* to expose opening 31. A longitudinal hole 46 serves as ribbon supply indicator extending radially to feed core 41 along the upper side of first part 35*a*. Second part 35*b* encloses the region of cassette 20 containing legs 21*a*. Second part 35*b* is removed before use of ink ribbon cartridge 20. A plate 38 preferably made of cardboard used for safety purposes during transportation is inserted below the top surface of first part 35*a*.

During shipping, the free end of plate 38 is inserted between take-up reel 41 and the top side of first part 35*a* so that feed core 41 is restricted without backlash between the underside of first part 35*a* and plate 38. Further, plate 38 covers longitudinal slot 46 and is removed together with part 35*b* before actual use. In this way, the necessary backlash is established for the free rotation of feed reel 40. For further protection during transport, a catch 26 is integrally attached to hollow peg 23. Catch 26 engages dog claws 41*a* of feed core 51, as shown in FIG. 8, preventing feed reel 40 from turning counter-clockwise.

When the supply of ribbon 42 is depleted during printing with cartridge 1 in place and adapter 13 inserted, activation lever 6 is rotated to the refill position as shown in FIG. 2. The spent cassette 20 is removed from housing 13. Tear-off strip 36 is removed from a new cassette 20, and second part 35*b* with plate 38 are removed. Corner 37 is separated along perforations 37*a*. The rear end of first part 35*a* is placed under cover 14 of housing 13. Hollow pegs 27 and 28 are placed on centering bodies 7 and 8. Pressure is applied on gripping tabs 33 to engage detent recesses 23 and projection 9 to secure the two members together.

When cassette 20 is loaded and activation lever 6 is in the loaded position, ribbon tension element 12 is biased counter-clockwise so that ribbon tension roller 54 is in the position shown in FIG. 1. Here, ribbon tension 54 is to the right of ribbon 42 which is tensioned in left support leg 21*a* between ribbon guiding elements 27 and 28 shown by dashes in FIG. 1. Upon insertion, casing 11*a* with its dogs 11*b* grip feed core 41 with its dog claws 41*a* simultaneously moving catch 26 out of engagement with claws 41*a*. At this point, take-up core 43 is centered about take-up 4. The underside of first part 35*a* of enclosure 35 lies between space webs 10 to lock the enclosure in a centered position.

Finally, activation lever 6 is returned back from the loading position as shown in FIG. 2 to the operating position as shown in FIG. 1. This forces drive wheel 53 against take-up core 43. Ribbon tensioning roll 54 then swings into the position shown by the solid lines in FIG. 1 in which it is partially surrounded by ribbon 42. Detent catches 19*a* of arm 19 engage teeth 50 of brake disk 11.

During operation drive pin 55 is turned ahead during each keystroke of the typewriter. This rotation of drive pin 55 is transferred through intermediate wheels 56 to driving wheel 53 which turns take-up reel 43*a* counter-clockwise and pulls ribbon 42 over the ribbon guiding elements 27 and 28. If the ribbon tension increases, a force acts on ribbon tensioning roll 54 to swing ribbon tensioning element 12 clockwise until detent catch 29 ceases to engage the teeth 50 of brake disk 11. Thereby, feed reel 40 can rotate one step further. Spring 15 and ribbon tensioning element 12 maintains a constant tension on ribbon 42 during operation through the system.

This design of cartridge 1 described above provides for simple replacement of an ink ribbon in a fashion analogous to replacement of an entire cartridge. In this embodiment, adapter 13 remains permanently inserted in the typewriter. Therefore, there is no complicated threading of a new ribbon. The ribbon is tensioned after insertion so that the take-up reel is wound tightly from the very beginning. In view of this, later operating disturbances can be avoided. Support 21 and cores 41 and 43 can be designed of a very light material and can be manufactured from the same material as the ribbon. Material costs and environmental burdens are kept low, particularly if the used material is recycled. Enclosure 34 is used both as transportation packaging and as a covering during operation providing further economical benefits.

Figure 9:
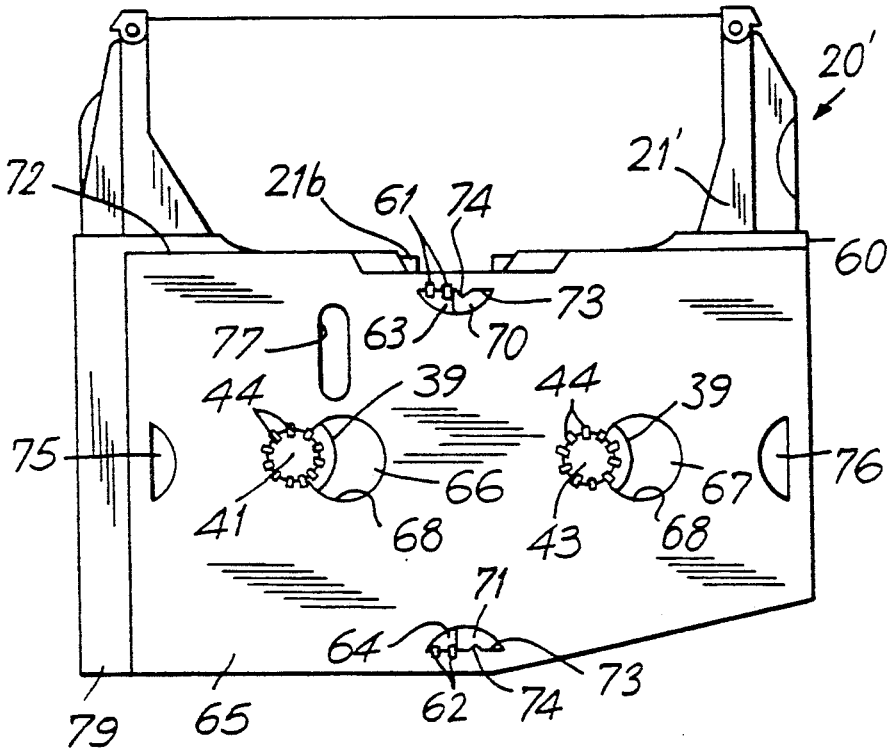
FIG. 9 is a plan view of a refillable ink ribbon cartridge with feed and wind-up reels secured in a locked position constructed in accordance with an alternative embodiment of the invention.
Figure 10:
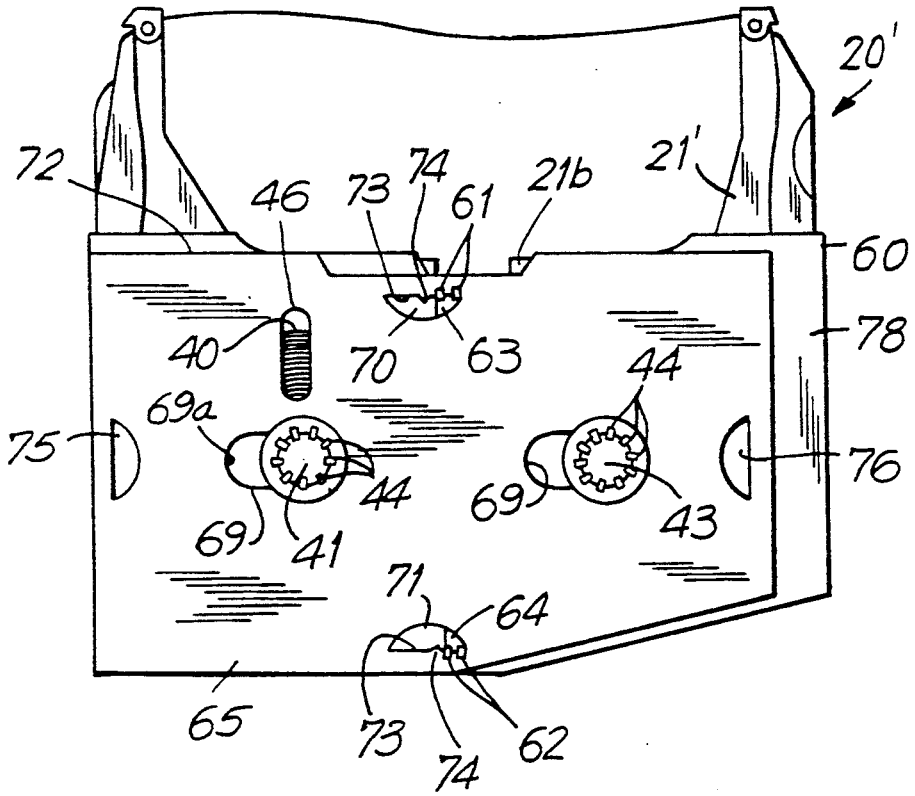
FIG. 10 is a plan view of the refillable ink ribbon cartridge of FIG. 9 with the reels in an unlocked position.

Cassette 20' in accordance with another embodiment of the invention shown in FIGS. 9 and 10 is designed for use in adapter 13 of FIGS. 2 and 3. Cassette 20' includes a support 21', a feed reel 40 including a feed core 41 take-up core 43 and a cardboard enclosure 60. Support 21' differs from support 21 of FIG. 7 only in that two hook-shaped detent springs 61 and 62 protrude upwards from side walls 21*b* adjoining its center plane. Enclosure 60 differs from first part 35*a* of enclosure 34 of FIGS. 4 and 5 with corner 37 removed only in that it additionally has two rectangular openings 63 and 64 through which extend detent springs 61 and 62. However, the transportation securing mechanism shown in FIGS. 9 and 10 differs from that in FIGS. 4–8. In the embodiment of FIGS. 9 and 10, the securing mechanism includes a top cover slide 65 made of cardboard attached to the upper surface of enclosure 60. Slide 65 is the same width as enclosure 60, but is slightly shorter in length. Slide 65 is formed with two longitudinal keyholes 66 and 67 through which extend detent projections 44 of cores 41 and 43.

Holes 66 and 67 have two edge sections 68 and 69 which are circular segments. Section 68 has a diameter which is larger than the outside diameter of the detent projections 44. Edge section 69 is smaller than recesses 39 in FIGS. 4–8. Slide 65 also has recesses 70 and 71 at its front and rear with an outer edge 73 parallel to longitudinal edge 72 of slide 65. A detent projection 74 extends from edge 73 and is engaged by the pair of hook-shaped springs 61 and 62. Slide 65 also has two gripper notches 75 and 76 which permit movement from an engaged position shown in FIG. 9 to a release position shown in FIG. 10.

In both positions, slide 65 is secured by detent springs 61 and 62 catching behind the detent projections 74. In the interlock position shown in FIG. 9, cores 41 and 43 are clamped in section 69 of holes 66 and 67 and are secured against rotation. At the same time, axial backlash between reel 40 and upper wall of enclosure 60 is eliminated in analogous fashion to FIG. 8, except that here the upper wall of enclosure 60 lies directly on feed reel 40.

In the release position of FIG. 10, the clamping of cores 41 and 43 is released and the upper wall of enclosure 60 is emoved from reel 40. In this release position, longitudinal slot 77 of slide 65 lies flush with longitudinal hole 46 of enclosure 60 so that the ribbon supply indicator is visible. In order to highlight the interlock position visually from the release position, the upper side of enclosure 60 may be colored green at right edge 78 and red at left edge 79. In an alternative embodiment, edges 78 and 79 may be labeled appropriately. Hole 66 also has a projection 69*a* at its edge section 69 to engage core 41 in a locked position and additionally secures feed reel 40.

The embodiment of FIGS. 9 and 10 has the primary advantage that cassette 20' may be removed from adapter 13 prior to exhaustion of supply of ribbon 42 and can be replaced with a ribbon of different quality or color. This permits switching a correctable with a non-correctable ribbon when it is desirable to be using permanent ink rather than erasable ink on the same typewriter. In such cases, slide 65 of cassette 20' is returned to its original interlocked position and subsequently removed from adapter 1. This secures feed reel 40 and take-up reel 43 against turning during the handling process so that the second cassette unit 20' may be easily inserted into adapter 1.

Figure 11:
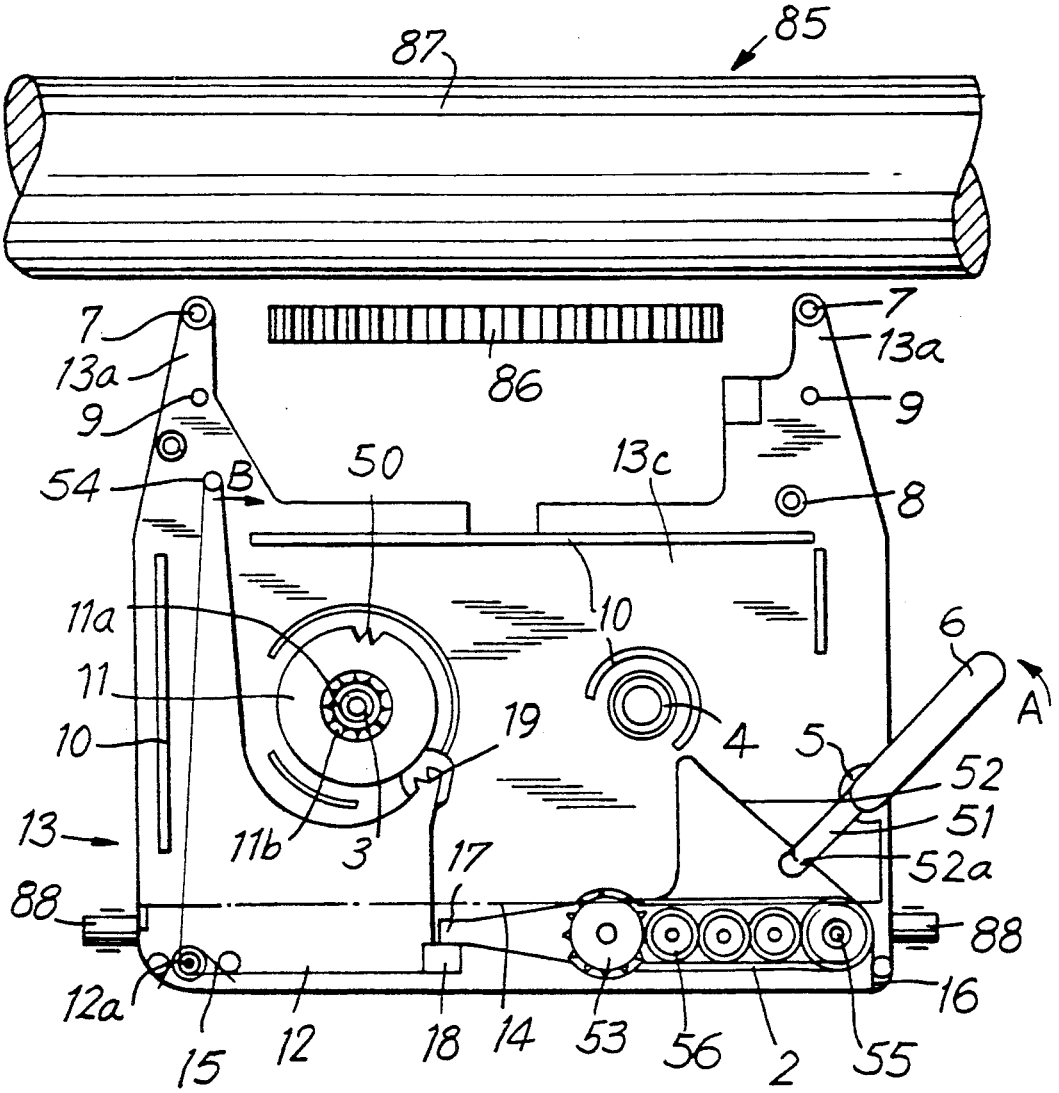
FIG. 11 is a top plan view of the cartridge of FIG. 1 inserted in a typewriter.

Referring specifically to FIG. 11, a further alternative embodiment of the invention is shown in which adapter 13 of FIG. 2 is a component part of a typewriter 85. Housing legs 13*a* extend on both sides of the character printing device, such as a type wheel 86 against a platen 87 and centering bodies 7 are directly adjacent to platen 87. Housing 13 is pivotably mounted in typewriter 85 about and axle 88 which is parallel to platen 87. In this configuration, ribbon 42, tensioned between the ribbon guide element 27, and guided between platen 87 and type wheel 86, can be switched between a raised write position to a lower read position. For purposes of clarity, elements not mentioned here but shown in FIG. 11 are identical to those described in connection with the earlier embodiment.

A further embodiment of the invention is shown in FIG. 12–14. Again, the same reference numerals are used for analogous parts as in FIG. 1–8 and a further detailed description is omitted here. In this embodiment, adapter 1' and cassette unit 20'' differs from that in FIGS. 1–8 only in the manner of centering legs 21*a*'' of support 21' on legs 13*a*'' of adapter 1' and by the function of a ribbon guiding element 27''. Parts not associated with the ribbon guide function and centering are omitted for clarity.

Housing legs 13*a*' contain centering bodies 7' as semi-cylindrical bolts 90 which protrude vertically from the housing legs 13*a*'. Bolts 90 are closed on top by a flange 91 which protrudes in the direction of the free ends of housing legs 13*a*'. Accordingly, the centering elements 27*b*' of cassette 20'' are semi-circular shells 92 adjoining the free ends of support legs 21*a*''. Support legs 21*a*'' each have a longitudinal hole 93 for insertion of bolt 90. Ribbon guiding element 27'' is formed by a front edge 94 of an extension 95 of side wall 21*b*'' of support 21''. Ribbon 42, shown in a dashed line, is bound on the top by a projection 96 to restrict slippage during operation.

The embodiment of FIG. 12 is designed for a typewriter which includes a ribbon guiding element 97. In such a typewriter, ribbon guiding element 97 is adjacent to platen 87' as shown in FIGS. 13 and 14. The outer spacing between two elements 97 is smaller than the spacing between an extension 95 of cassette unit 20''. To insert the cassette unit 20'', ribbon 42 is first inserted between ribbon guiding elements 97 and platen 87' by means of extensions 95 and support legs 21'' with bolts 90 inserted into longitudinal hole 93. Cassette unit 20'' is slanted with respect to adapter 1' as shown by arrow A of FIG. 13. At this point, cassette unit 20'' is pulled back in the direction of the arrow B until semi-circular receiving elements 92 embrace bolts 90 with a positive interlocking fitting. Finally, cassette 20'' is pushed in a downward direction of arrow C so that feed core 41'' is placed on casing 11*a*''.

In the position shown in FIG. 14, the typewriter is ready to commence normal operation. The relatively soft support legs 21*a*'' are again centered precisely by rigid bolts 90. Flanges 91 overlap semi-circle receiving elements 92 so that the cassette unit 20'' is securely held on adapter 1'. In typewriters which do not contain ribbon guiding elements 97, longitudinal holes 93 may be designed shorter to accommodate the system disclosed in FIGS. 12–14.

Accordingly, by providing a refillable ink ribbon cartridge in accordance with the invention as described, a simple, economical and ecological ink ribbon cartridges will be available. A two part cartridge system containing an adapter with drive mechanism and a replaceable ink ribbon cassette unit enables a user to replace fewer parts. Therefore, refills can be provided at lower costs. This reduces production costs and storage costs as this ribbon refill is less expensive to replace and smaller to store. The system provides a smooth running ribbon which is taut during operation creating accurate keystrokes with clear printed characters on the paper.

It will thus be seen that the objects set forth above, among those made apparent from the preceding description, are efficiently attained and, since certain changes may be made in the above construction without departing form the spirit and scope of the invention, it is intended that all matter contained in the above description or shown in accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A refillable ink ribbon cartridge for mounting in a typewriter comprising:

an adapter including a housing having two protruding housing legs and a first and a second housing peg fixed to the housing, centering bodies mounted on the housing legs, a supply mandrel rotatably supported on the first housing peg, a brake operatively connected to the supply mandrel, a take-up mandrel rotatably supported on the second housing peg; and a pivotable drive lever with a drive wheel mounted thereon and biased towards the take-up mandrel; and a cassette including a support having two protruding support legs, a ribbon guide element formed on a free end of each of the support legs, centering means for centering on the corresponding centering bodies on the housing legs, the centering means formed in each of the support legs adjacent said ribbon guide element, a first hollow support peg and a second hollow support peg formed on said support, a feed core for centering on and coupling with said supply mandrel, a supply spool of ink ribbon being wound onto said feed core, said feed core being snapped onto and rotatable on said first hollow support peg, a take-up core for centering on said take-up mandrel, said take-up core being snapped onto and rotatable on said second hollow support peg, one end of the ribbon being fixed to said take-up core and the ribbon being spanned from said supply spool through said two ribbon guide elements to the take-up core, and an opening in said support adjacent said take-up core for receiving said drive lever.

2. The refillable ink ribbon cartridge of claim 1, wherein the centering refillable bodies at the free ends of the housing legs include projections which projections extend towards the free end of the housing legs for overlapping the centering elements on the support legs.

3. The refillable ink ribbon cartridge of claim 1, wherein the housing legs include snap elements for engaging the support legs.

4. The refillable ink ribbon cartridge of claim 1, wherein the ribbon guide elements are formed at the free end of the support legs by extensions formed by a side wall extending from the support and the support legs have upwardly extending curved centering elements for engagement by the corresponding formed centering bodies of the housing for locking the support to the housing.

5. The refillable ink ribbon cartridge of claim 4, wherein the centering bodies of the housing legs include a flange extending towards the free end of the legs for overlapping the centering element of the support legs.

6. The refillable ink ribbon cartridge of claim 1, wherein said drive lever includes a handle for manually pivoting said drive lever from a first engaged position in which said drive wheel is pressed towards said take-up mandrel to a loading position in which said drive wheel is spaced from said take-up mandrel.

7. The refillable ink ribbon cartridge of claim 1, wherein said supply mandrel further includes a brake disk, a brake lever being pivotally mounted in said housing, a first arm of said brake lever being biased for engagement with the brake disk, and the ribbon being looped around a pin on a second arm of said brake lever for disengaging said first arm from said brake disk upon tensioning of the ribbon.

8. The refillable ink ribbon cartridge of claim 7, wherein said drive lever include pivot means for pivoting said brake lever against its biassing force in the loading position of the drive lever.

9. A replaceable ink ribbon cassette for use in an adapter mounted in a typewriter, the adapter having a housing formed with two protruding housing legs, centering bodies mounted on the housing legs, a supply mandrel and a take-up mandrel rotatably supported in the housing and pivotable drive lever and a drive wheel mounted thereon and biassed towards the take-up mandrel, comprising:

a support having two protruding support legs;

a ribbon guide element formed on a free end of each of the support legs;

centering means for centering on the corresponding centering bodies on the housing legs formed in each of the support legs adjacent said ribbon guide element;

a first hollow support peg and a second hollow support peg formed on said support;

a feed core for centering on and coupling with said supply mandrel, a supply spool of ink ribbon being wound onto said feed core, said feed core being snapped onto and rotatable on said first hollow support peg;

a take-up core for centering on said take-up mandrel, said take-up core being snapped onto and rotatable on said second hollow support peg, one end of the ribbon being fixed to said take-up core and the ribbon being spanned from said supply spool to said two ribbon guide elements to the take-up core; and an opening in said support adjacent said take-up core for receiving said drive lever.

10. The ink ribbon cartridge of claim 9, wherein the ribbon guide elements in the support legs are hollow for receiving the centering bodies on the housing legs, the hollow guide elements including upper flanges for restraining a ribbon fed about the free ends of the legs and guide elements.

11. The ink ribbon cassette of claim 9, wherein a covering is provided over the supply spool and the take-up core and has openings penetrated by the feed core and take-up core the feed core and take-up core being formed with outwardly extending projections for engaging the top surface of the covering.

12. The ink ribbon cartridge of claim 11, wherein the covering is designed as an outer casing for enclosing the ribbon supply during shipment.

13. The ink ribbon cartridge of claim 12, wherein the covering has a first portion covering the body portion of the support and a second removable portion covering the support legs.

14. The ink ribbon cassette of claim 13, wherein the covering includes a tear-off ribbon for removing the portion of the covering over the legs to free the ribbon for insertion into the housing.

15. The ink ribbon cassette of claim 12, wherein the covering includes a slide which can be moved from a first storage position engaging the feed core and take-up core to prevent rotation thereof and a second operating position wherein the feed core and take-up core are free to rotate in response to the drive wheel.

16. The ink ribbon cassette of claim 15, wherein the slide has two openings for receiving the upper portions of the feed core and take-up core, the slide openings being formed with a first opening portion having a circular cut-out for receiving the feed core and the take-up core and an adjoining portion of reduced width for engaging the core and spool when the covering is displaced into the storage position.

* * * * *